US010322829B2

(12) United States Patent
Scholl

(10) Patent No.: US 10,322,829 B2
(45) Date of Patent: Jun. 18, 2019

(54) DEVICE, METHOD AND PACKAGING MACHINE FOR PROCESSING A PACKAGING CONTAINER

(71) Applicant: Robert Bosch GmbH, Stuttgart (DE)

(72) Inventor: Frank Scholl, Schlatt (CH)

(73) Assignee: Robert Bosch GmbH, Stuttgart (DE)

( * ) Notice: Subject to any disclaimer, the term of this patent is extended or adjusted under 35 U.S.C. 154(b) by 218 days.

(21) Appl. No.: 15/523,937

(22) PCT Filed: Sep. 28, 2015

(86) PCT No.: PCT/EP2015/072224

§ 371 (c)(1),
(2) Date: May 2, 2017

(87) PCT Pub. No.: WO2016/071041

PCT Pub. Date: May 12, 2016

(65) Prior Publication Data

US 2017/0320603 A1 Nov. 9, 2017

(30) Foreign Application Priority Data

Nov. 3, 2014 (DE) ..... 10 2014 222 367

(51) Int. Cl.
*B65B 13/02* (2006.01)
*B65B 11/02* (2006.01)
(Continued)

(52) U.S. Cl.
CPC ..... *B65B 13/022* (2013.01); *B65B 11/025* (2013.01); *B65D 5/722* (2013.01); *B65B 2011/002* (2013.01); *B65D 5/52* (2013.01)

(58) Field of Classification Search
CPC ..... B65B 13/022; B65B 11/025; B65B 2011/002; B65D 5/722; B65D 5/52
See application file for complete search history.

(56) References Cited

U.S. PATENT DOCUMENTS 4,649,697 A * 3/1987 Konstantin ..... B67B 5/036 53/291
2003/0051439 A1* 3/2003 Lancaster, III ..... B65B 11/025 53/399

(Continued)

FOREIGN PATENT DOCUMENTS

GB 754069 A 8/1956
WO 2014006398 1/2014

OTHER PUBLICATIONS

International Search Report for Application No. PCT/EP2015/072224 dated Jan. 11, 2016 (English Translation, 2 pages).

*Primary Examiner* — Zakaria Elahmadi
(74) *Attorney, Agent, or Firm* — Michael Best & Friedrich LLP

(57) ABSTRACT

The invention relates to a device for processing at least one packaging container, in particular for stretching out at least one stretching element of the packaging container, comprising at least one pivoting-arm pair, which comprises a first pivoting arm and a second pivoting arm, which is arranged in a mirror-symmetric manner in relation to the first pivoting arm with respect to an axis of symmetry perpendicular to the at least one linear axis, wherein the first pivoting arm is supported in such a way that the first pivoting arm can be rotated about a first pivoting-arm axis of rotation perpendicular to the axis of symmetry in a first rotational motion and can be displaced in the direction of the at least one linear axis in a first displacement motion and the second pivoting arm is supported in such a way that the second pivoting arm can be rotated about a second pivoting-arm axis of rotation perpendicular to the axis of symmetry in a second rotational motion and can be displaced in the direction of the at least one linear axis in a second displacement motion, and comprising a coupling transmission, which is designed to produce the first rotational motion and the first displacement (Continued)

motion of the first pivoting arm and the second rotational motion and the second displacement motion of the second pivoting arm from at least one first driving motion and one second driving motion, and wherein the first rotational motion and the second rotational motion are synchronous to each other and in opposite directions and the first displacement motion and the second displacement motion are synchronous to each other and in opposite directions.

11 Claims, 7 Drawing Sheets

(51) Int. Cl.

| | |
|---|---|
| ***B65D 5/72*** | (2006.01) |
| *B65B 11/00* | (2006.01) |
| *B65D 5/52* | (2006.01) |

(56) References Cited

U.S. PATENT DOCUMENTS

2010/0107563 A1* 5/2010 Swift ..... B65B 13/022
53/399
2012/0137636 A1* 6/2012 Ours ..... B65B 1/02
53/452

* cited by examiner 10c
42c
70c
68c
46c
26c'',30c''
16c
32c
66c
48c
96c
58c
88c'
26c',30c'
34c'',38c''
90c''
28c
50c
59c
67c
98c
40c
34c',38c'
62c
60c
54c
52c
44c
56c
64c
90c'
36c
86c'
24c'
18c'
12c'
22c'
36c
84c'
20c'
24c''
86c''
22c''
12c''
18c''
84c''
20c''
28c
88c''

DEVICE, METHOD AND PACKAGING MACHINE FOR PROCESSING A PACKAGING CONTAINER

BACKGROUND OF THE INVENTION

A device for processing at least one packaging container, in particular for tensioning at least one tensioning element of the packaging container, has already been proposed. Such a packaging container with a tensioning element and a device for tensioning the tensioning element are disclosed in WO2014006398A2.

SUMMARY OF THE INVENTION

Proposed is a device for processing at least one packaging container, in particular for tensioning at least one tensioning element of the packaging container, having at least one linear axis, having at least one pair of pivot arms which includes a first pivot arm and a second pivot arm which is arranged in a mirror-symmetrical manner with respect to the first pivot arm with reference to a symmetry axis which is perpendicular to the at least one linear axis, wherein the first pivot arm is mounted so as to be rotatable in a first rotational movement about a first pivot arm rotational axis which is perpendicular to the symmetry axis and displaceable in a first displacement movement in the direction of the at least one linear axis and the second pivot arm is mounted so as to be rotatable in a second rotational movement about a second pivot arm rotational axis which is perpendicular to the symmetry axis and displaceable in a second displacement movement in the direction of the at least one linear axis, and having a coupler mechanism which is provided for the purpose of generating the first rotational movement and the first displacement movement of the first pivot arm and the second rotational movement and the second displacement movement of the second pivot arm from at least one first drive movement and one second drive movement, and wherein the first rotational movement and the second rotational movement as well as the first displacement movement and the second displacement movement are in each case synchronous with one another in opposite directions.

As a result of the development according to the invention of the device for processing at least one packaging container, a processing step can be carried out in a particularly flexible and advantageous manner. In particular, a path of active means of the pairs of pivot arms necessary for the processing step can be established in two degrees of freedom. The device can be particularly compact and can be especially suitable for retrofitting existing packaging machines. The device can also be realized as an exchangeable module. The device can simply be attachable to and removable from several packaging machines and/or can be exchanged between several packaging machines. The movement of the pairs of pivot arms in two degrees of freedom can be driven by only two drive movements and consequently only two independent drives. The device can be particularly cost-efficient. In a preferred manner, the drives can be arranged in a stationary manner on a machine base of the device. Moving loads can be particularly small. Moving energy-conducting elements, such as, in particular, current and/or pneumatic lines, can be avoided. In particular, the displacement movement and the rotational movement can be driven by the stationary drives. A moving load is able to be reduced, in particular compared to a device with rotary drives which are displaced in the displacement movements together with the pivot arms.

In a preferred manner, the pairs of pivot arms are mounted so as to be displaceable in the direction of the pivot arm rotational axis and so as to be drivable by means of a lift drive. The pairs of pivot arms can be moved advantageously out of engagement with the packaging machine and/or can be moved into engagement with the packaging machine by means of a lifting movement. Provision/removal of packaging containers can be made easier.

A "packaging container" is to be understood in this context as a container which is provided for the packaging of products such as piece goods and/or bulk goods, such as, in particular, chocolate bars or biscuits. In a preferred manner, the packaging container is provided as further packaging or multiple packaging of already packaged piece and/or bulk goods. In a preferred manner, the packaging container is realized as a folding box. It is also possible for the device to be provided for processing a packaging blank, in particular a cardboard blank which is not yet formed or not yet completely formed into a folding box. A "tensioning element" is to be understood in this context, in particular, as an elastic element which is provided for the purpose of exerting a tension force on products placed in the packaging container. In particular, where the packaging container is partially filled, the tensioning element can be provided for the purpose of pushing the remaining packaged products in the direction of a removal opening. This can facilitate removal and/or improve product presentation in an advantageous manner, for example at a point of sale. The tensioning element can be formed by a folded cardboard element. In an advantageous manner, the tensioning element can be formed by an elastic band, in particular a rubber band. The tensioning element is advantageously part of the packaging container and connected to said packaging container.

A "linear axis" is to be understood in this context in particular as a bearing means which allows for a bearing arrangement of elements with a movable degree of freedom in a displacement direction in the direction of a straight line. In a preferred manner, the linear axis comprises bearing deviations from the straight line within the range of usual production-related tolerances. In a preferred manner, the deviations are smaller than 5 mm per meter bearing section, in a particularly preferred manner less than 1 mm. The device can comprise several linear axes which are parallel to one another. In a preferred manner, the device comprises one common linear axis for the bearing arrangement of the pivot arms. Tolerances as a result of deviation of several linear axes from parallelism can be avoided.

A "pivot arm" is to be understood in this context as an element which is mounted on a pivot arm rotary bearing so as to be rotatable about a pivot arm rotational axis and comprises at least one active means which is pivotable about the pivot arm rotational axis at a radius to the pivot arm rotational axis. The active means is provided in a preferred manner for the purpose of processing the packaging container and/or the tensioning element of the packaging container. In a preferred manner, the pivot arm rotational axes are arranged perpendicular to the linear axis. The pivot arm rotational axes, in this case, are parallel to a symmetry plane through the symmetry axis. However, it is also possible for the first pivot arm rotational axis of the first pivot arm and the second pivot arm rotational axis of the second pivot arm to span with the linear axis an angle that deviates from a perpendicular to the linear axis and for the first and the second pivot arm to be rotated about first and second pivot arm rotational axes which are angled with respect to one another in a mirror-symmetrical manner to the linear axis. In a preferred manner, the pivot arm rotary bearing is displaceably mounted, in turn, on the linear axis. In a preferred manner, the pivot arm comprises the active means on an end region which is situated opposite the pivot arm rotational axis, the active means being provided for processing the packaging container. In a preferred manner, the active means is provided for the purpose of tensioning the tensioning element of the packaging container. In a preferred manner, the active means can carry out further processing steps on the packaging container, in particular folding open the packaging container and/or holding up the packaging container. The active means can be, in particular rod-shaped, a rod axis of the rod being arranged in a preferred manner parallel to the pivot arm rotational axis of the pivot arm. The active means can take up particularly little space in a region of the packaging container. The packaging container can be filled especially well and/or completely with products whilst the active means is engaged with the tensioning element. A non-occupied zone of the container which has to be kept free for the engagement of the active means with products, can be smaller than 10*10 mm. The active means can comprise gripping means and/or vacuum cups. The active means can be usable in a particularly versatile manner. It is possible for several active means to be arranged on the pivot arm. The active means can be matched particularly well to different processing steps.

A "coupler mechanism" is to be understood in this context in particular as a device which is provided for the purpose of translating and/or transmitting the drive movements in a preferred manner in a positive locking manner to the pivot arms in order to drive the pivot arms in the rotational and displacement movements.

"Synchronous in opposite directions" is to be understood in this context as two straight movements which, at the identical speed value, comprise movement vectors which are opposite to one another about 180°, and/or two rotations at the identical speed and in directions of rotation which are in opposite directions to one another. In particular, where the rotational movement is synchronous in opposite directions, angles which are spanned by the first and the second pivot arms with the symmetry axis are always the same size and where the displacement movement is synchronous in opposite directions, the symmetry axis, about which the pivot arms are arranged in a mirror-symmetrical manner, remains non-movable in the direction of displacement.

A "drive movement" is to be understood in this context in particular as a movement which is controllable or regulatable in one degree of freedom by a control unit and which is provided for driving the device. The drive movements can be brought about, in particular, in each case by a drive motor which, in a preferred manner, is electric. In a preferred manner, the drive movements are in each case rotations about drive axes. In a preferred manner, the control unit is provided for the purpose of controlling and/or regulating the first and the second drive movements in at least one operating state at the same time, such that the at least one pair of pivot arms is driven with the displacement and rotational movements established for the processing step and the active means of the pair of pivot arms carry out a desired path in a first degree of freedom in the direction of the linear axis and in a second degree of freedom in the direction of the symmetry axis. The path of the active means can be adapted by changing software or control parameters of the control unit. In a preferred manner, the control unit can be provided for the purpose of acquiring torques of the first and of the second drive movements. A tension force of the tensioning element can be determined from the torques of the first and of the second drive movements.

In a preferred manner, the packaging container to be processed is arranged symmetrically with respect to the symmetry axis at least during a processing step. The device and/or a packaging machine comprising the device can comprise means in order to transport the packaging container to said position and after the processing step to transport them away from said position again. The first and the second pivot arms can carry out a symmetrical processing step on the packaging container, in particular tensioning a tensioning element, such as a rubber band, in a symmetrical manner. In a preferred manner, the products to be packaged can be placed into the packaging container during and/or after the tensioning of the tensioning element. In a preferred manner, the pivot arms and/or the active means of the pivot arms can be withdrawn from engagement with the packaging container in a next step. In a preferred manner, the active means can be mounted so as to be displaceable in the direction of the pivot arm rotational axis of the respective pivot arm and/or withdrawable in order to withdraw the active means from engagement with the packaging container.

In addition, proposed is a plurality of pairs of pivot arms having in each case a first pivot arm and a second pivot arm, wherein in a preferred manner in each case one pair of pivot arms is provided for processing a packaging container. In a preferred manner, the pairs of pivot arms are arranged side by side in the direction of the linear axis. In a preferred manner, the packaging containers are also arranged side by side in the direction of the linear axis, at a distance from the linear axis in the direction of the symmetry axis. In a preferred manner, the distance and a direction of the distance are chosen such that the active means of the pivot arms can carry out the desired processing step on the packaging containers. In a preferred manner, the coupler mechanism is provided for the purpose of driving the first pivot arms in the first displacement movement and the first rotational movement and driving the second pivot arms in the second displacement movement and the second rotational movement in a synchronous manner in opposite directions. In a preferred manner, the first and the second displacement movements and the first and the second rotational movements are generated by the coupler mechanism from the first and the second drive movements. Four movements can be generated from two drive movements. The first and the second displacement movements as well as the first and the second rotational movements, in this case, comprise two degrees of freedom overall on account of their synchronous coupling in opposite directions.

In a particularly advantageous manner in at least one operating state, at least one second pivot arm of a pair of pivot arms and one first pivot arm of a further pair of pivot arms adjacent in the direction of the linear axis are arranged so as to cross over. "Arranged so as to cross over" is to be understood in this context, in particular, as the pivot arms crossing, proceeding from their pivot arm rotational axes toward the active means when viewed from a direction which is perpendicular to the linear axis and to the symmetry axes of the pairs of pivot arms. In a preferred manner, the second pivot arm of a pair of pivot arms and the first pivot arm of the further pair of pivot arms adjacent in the direction of the linear axis cross, at least occasionally, whilst the pivot arms on the packaging containers carry out a processing step. The first pivot arm rotational axes of the adjacent pairs of pivot arms and the second pivot arm rotational axes of the adjacent pairs of pivot arms can be arranged in each case side by side along the linear axis. The active means of the first pivot arm and of the second pivot arm of the first pair of pivot arms and the active means of the first pivot arm and of the second pivot arm of the further pair of pivot arms can be arranged in each case side by side in the direction of the linear axis. The device can comprise a particularly small extent in the direction of the linear axis. The coupler mechanism for generating the first rotational movement of the first pair of pivot arms and for generating the second rotational movement of the second pair of pivot arms can be designed in a particularly simple manner.

It is further proposed that at least two first pivot arms and/or at least two second pivot arms are rotatably mounted in each case on one common carriage which is mounted so as to be displaceable on the linear axis. In a preferred manner, two first pivot arms are mounted on a first carriage which is mounted on the linear axis so as to be displaceable and two second pivot arms are rotatably mounted on a second carriage which is mounted on the linear axis so as to be displaceable. In a particularly simple manner, the coupler mechanism can transmit the first displacement movement to the first carriage on which the first pivot arms are mounted and can transmit the second displacement movement to the second carriage on which the second pivot arms are mounted. The bearing arrangement of the pivot arms in the direction of the displacement movement and the transmission of the first and of the second displacement movements can be particularly simple.

It is proposed that the coupler mechanism comprises at least one first mechanism element which is provided for the purpose of generating from the first drive movement a first advance movement which is parallel to the linear axis and a synchronous first return movement which is parallel to the linear axis and is in the opposite direction to the first advance movement. Which of the two synchronous movements that are in opposite directions is designated as the "advance movement" and which as the "return movement", is provided simply by a convention which can be freely established by the person skilled in the art. A "mechanism element" is to be understood in this context as part of the coupler mechanism which includes one or more components and is provided for the purpose of ensuring a force and/or movement transmission in the described manner. In a preferred manner, the first return movement comprises a speed value which matches the first advance movement and an opposing direction vector. The first mechanism element can comprise two elements which are moved by the first drive movement in opposite directions to one another, such as, for example, toothed rods. A coupler mechanism can transmit the drive movement to the toothed rods in the opposite directions to one another. The mechanism element can comprise at least one lever element. The lever element can be mounted at a pivot point arranged between the elements which are moved in opposite directions and, as a result of a rotation about said pivot point, can transmit the movement of one of the moving elements to the further one of the moving elements in the opposite direction. At least one of the moving elements can be driven by a linear drive and/or linear motor. In a preferred manner, the first mechanism element comprises a circulating element such as a chain or, in a particularly preferred manner, a toothed belt. The circulating element can be driven by the first drive movement in a circuit with an advance section and a return section, the advance section and the return section being parallel to the linear axis. The first mechanism element and/or the circuit of the first mechanism element can comprise an advance side, along which the first mechanism element carries out the advance movement parallel to the linear axis, and a return side, along which the first mechanism element carries out the return movement parallel to the linear axis. The first mechanism element can generate the first advance movement and the first return movement from the first drive movement in a particularly simple and efficient manner.

It is further proposed that the coupler mechanism comprises coupling means which are provided for the purpose of transmitting the first advance movement to the at least one first pivot arm and the first return movement to the at least one second pivot arm. In a preferred manner, the coupling means can produce in each case a positive locking connection between the advance movement and the at least one first pivot arm as well as between the return movement and the at least one second pivot arm. In a preferred manner, the first advance movement is transmitted to the at least one first pivot arm rotary bearing and the first return movement is transmitted to the at least one second pivot arm rotary bearing. The at least one first pivot arm and the at least one second pivot arm can be driven in a particularly simple manner in opposite directions synchronously with the first advance and return movements in the opposite directions.

It is proposed that the coupler mechanism comprises at least one second mechanism element which is provided for the purpose of generating from the second drive movement a second advance movement which is parallel to the linear axis and a synchronous second return movement which is parallel to the linear axis and is in the opposite direction to the second advance movement. In a preferred manner, the second return movement comprises a speed value which matches the second advance movement with a direction vector in the opposite direction. The second mechanism element can comprise two elements which are moved by the second drive movement in opposite directions, such as, for example, toothed rods. A coupler mechanism can transmit the drive movement to the toothed rods in the opposite directions to one another. The second mechanism element, as the first mechanism element, can comprise a lever element and/or a linear drive and/or can be driven by a linear motor. In a preferred manner, the second mechanism element comprises a circulating element such as a chain or, in a particularly preferred manner, a toothed belt. The circulating element can be driven by the second drive movement in a circuit with an advance section and a return section, the advance section and the return section being parallel to the linear axis. The second mechanism element and/or the circuit of the second mechanism element can comprise an advance side, along which the second mechanism element carries out the advance movement parallel to the linear axis, and a return side, along which the second mechanism element carries out the return movement parallel to the linear axis. The second mechanism element can generate the second advance movement and the second return movement from the second drive movement in a particularly simple and efficient manner.

It is further proposed that the coupler mechanism comprises rotary coupling means which are provided for the purpose of generating the at least one first rotational movement from a relative movement of the second advance movement with reference in each case to the at least one first pivot arm rotational axes and the at least one second rotational movement from a relative movement of the second return movement with reference in each case to the at least one second pivot arm rotational axes. It can be provided in a variant that the coupler mechanism comprises rotary coupling means which are provided for the purpose of generating the at least one second rotational movement from a relative movement of the second advance movement with reference in each case to the at least one second pivot arm rotational axes and the at least one first rotational movement from a relative movement of the second return movement with reference in each case to the at least one first pivot arm rotational axes. A "relative movement" is to be understood in this context as a resultant movement difference between two movements. The rotational movement can be generated by the rotary coupling means comprising pivotally mounted means which flexibly connect the second mechanism element, in a region in which it comprises the second advance movement, to the at least one first pivot arm in a radius outside the pivot arm rotational axis of said pivot arm and by the rotary coupling means comprising further pivotally mounted means which flexibly connect the second mechanism element, in a region in which it comprises the second return movement, to the at least one second pivot arm in a radius outside the pivot arm rotational axis of said pivot arm. In a preferred manner, the first and the second pivot arms can comprise drive wheels, in particular toothed wheels, which are arranged about the first and the second pivot arm rotational axes. The coupler mechanism can comprise at least one coupling means which transmits the second advance movement to a circumference of an at least one first toothed wheel of the at least one first pivot arm, and can comprise at least one coupling means which transmits the second return movement to a circumference of an at least one second toothed wheel of the at least one second pivot arm. The coupler mechanism can comprise, in particular, toothed belts and/or toothed rods for the transmission. The at least one first pivot arm and the at least one second pivot arm can be driven in a particularly simple manner in the synchronous first and second advance and return movements which are in opposite directions to one another and in the synchronous first and second rotational movements which are in opposite directions to one another. The control unit of the drive units can control the first and second drive movements such that the first and second pivot arms carry out the desired first and second displacement movements and the desired first and second pivoting movements.

It is proposed that a packaging machine comprises the described device according to the invention. The packaging machine can comprise the named advantages.

Further proposed is a method for processing at least one packaging container, in particular for tensioning at least one tensioning element of the packaging container, having a device with at least one pair of pivot arms which includes at least one first pivot arm and a second pivot arm which is arranged in a mirror-symmetrical manner to the first pivot arm with reference to a symmetry axis which is perpendicular to a linear axis, wherein during the method the first pivot arm is rotated in a first rotational movement about a first pivot arm rotational axis which is perpendicular to the symmetry axis and is displaced in a first displacement movement in the direction of the linear axis and the second pivot arm is rotated in a second rotational movement about a second pivot arm rotational axis which is perpendicular to the symmetry axis and is displaced in a second displacement movement in the direction of the linear axis, wherein a coupler mechanism generates the first rotational movement and the first displacement movement of the first pivot arm and the second rotational movement and the second displacement movement of the second pivot arm from at least one first drive movement and one second drive movement, and wherein the first rotational movement and the second rotational movement as well as the first displacement movement and the second displacement movement are in each case synchronous with one another in opposite directions.

The device according to the invention for processing at least one packaging container is not to be limited in this respect to the above-described application and embodiment. In particular, for fulfilling a method of operation described herein, the device according to the invention for processing at least one packaging container can comprise a number of individual elements, components and units which deviates from the number named herein.

BRIEF DESCRIPTION OF THE DRAWINGS

Further advantages are produced from the following description of the drawing. Five exemplary embodiments of the invention are shown in the drawing. The drawing, the description and the claims include numerous features in combination. The person skilled in the art will also observe the features in an expedient manner individually and combine them to form sensible further combinations.

The drawing is as follows.

DETAILED DESCRIPTION

Figure 3:
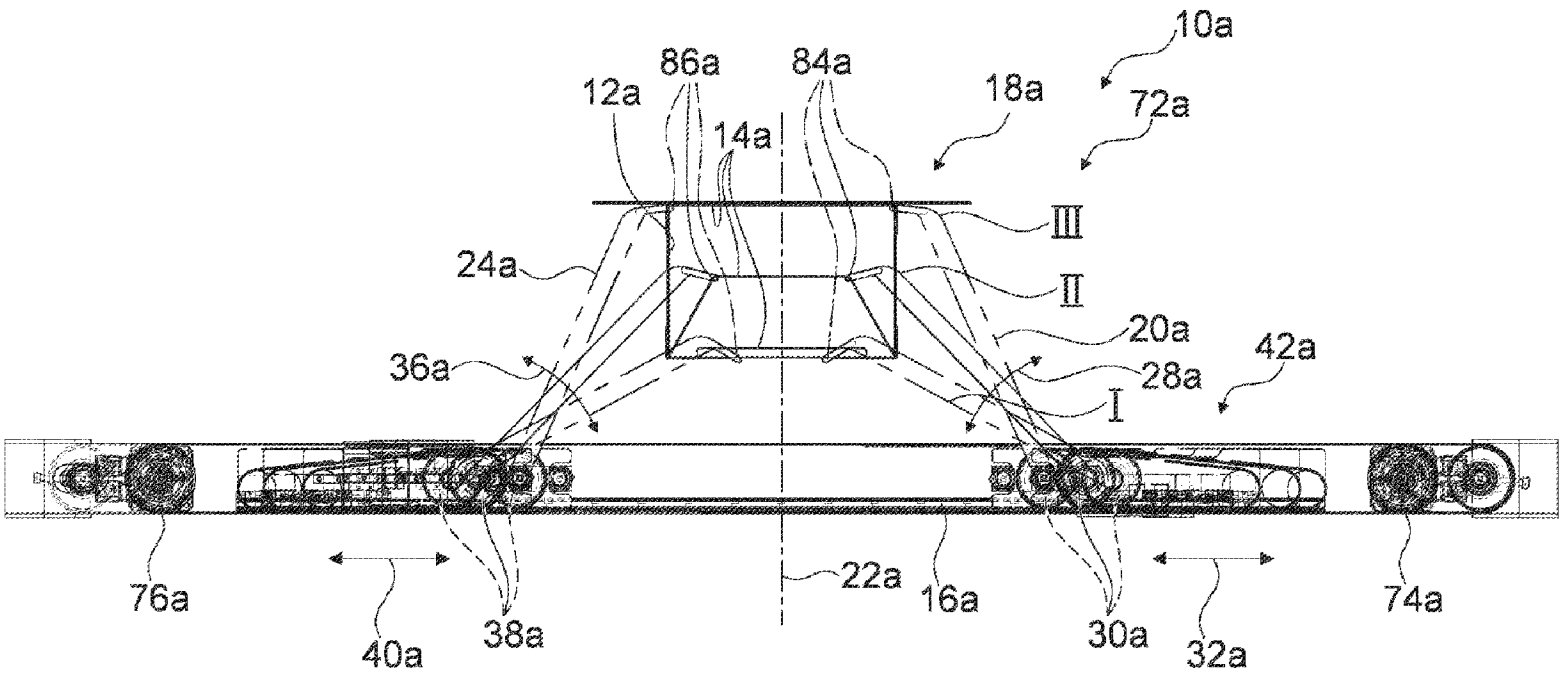
FIG. 3 shows a third view of the device according to the invention of the first exemplary embodiment.
Figure 4:
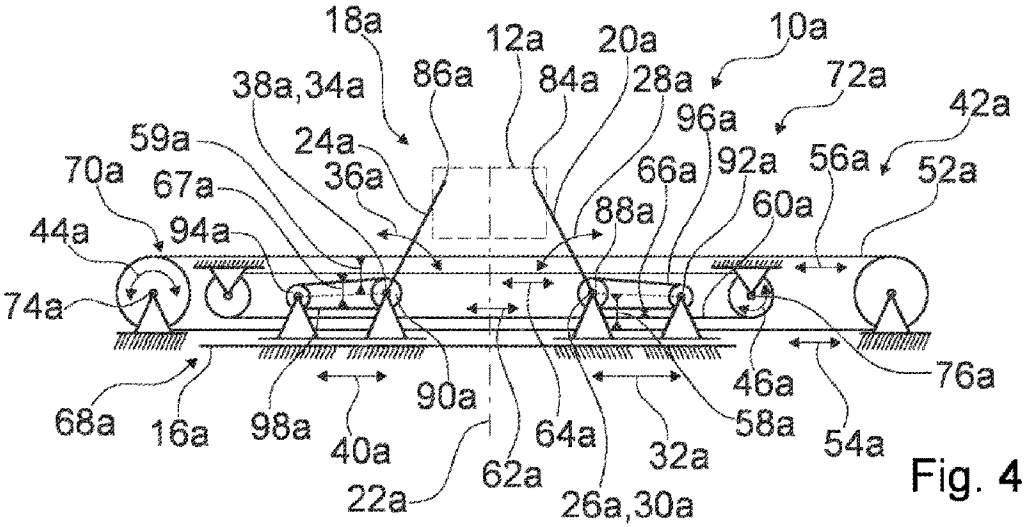
FIG. 4 shows a functional diagram of the device according to the invention of the first exemplary embodiment.

FIGS. 1 to 4 show a detail of a packaging machine 72*a* with a device 10*a* according to the invention in a first exemplary embodiment. FIG. 3 shows a schematic diagram of the kinematics of the device 10*a* in three different positions I to III. The device 10*a* serves for tensioning a tensioning element 14*a* of a packaging container 12*a*, which is realized as a rubber band.

Figure 1:
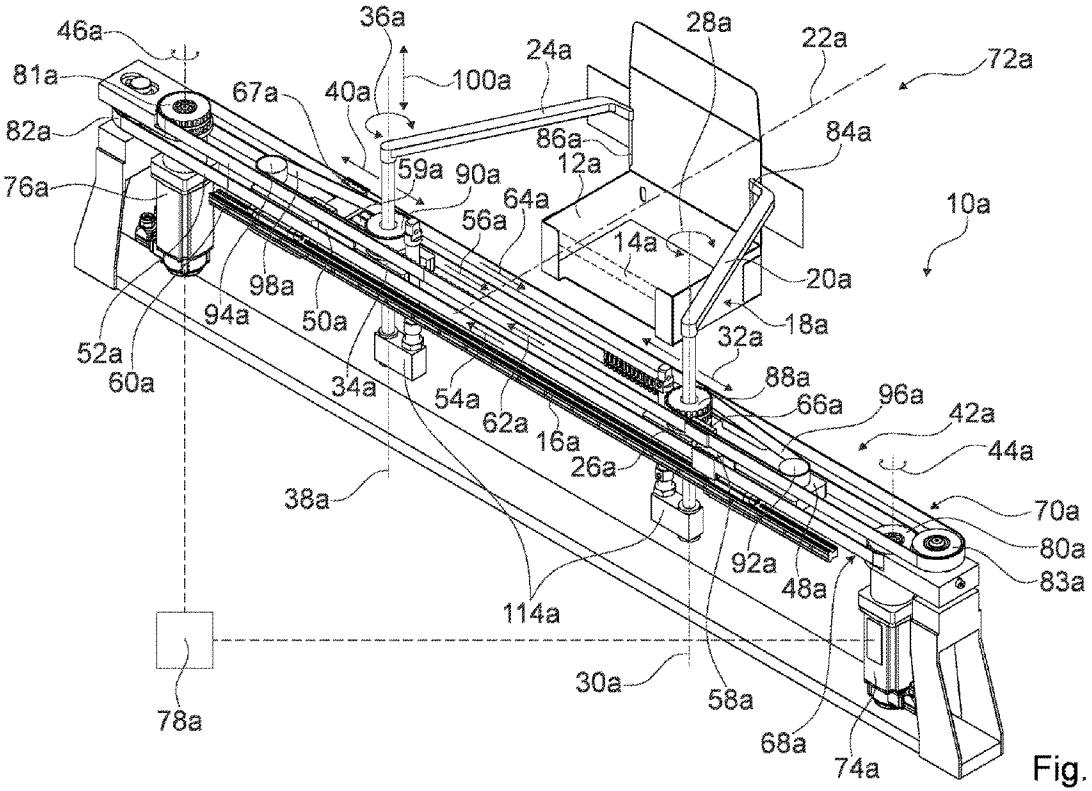
FIG. 1 shows a view of a device according to the invention in a first exemplary embodiment.
Figure 2:
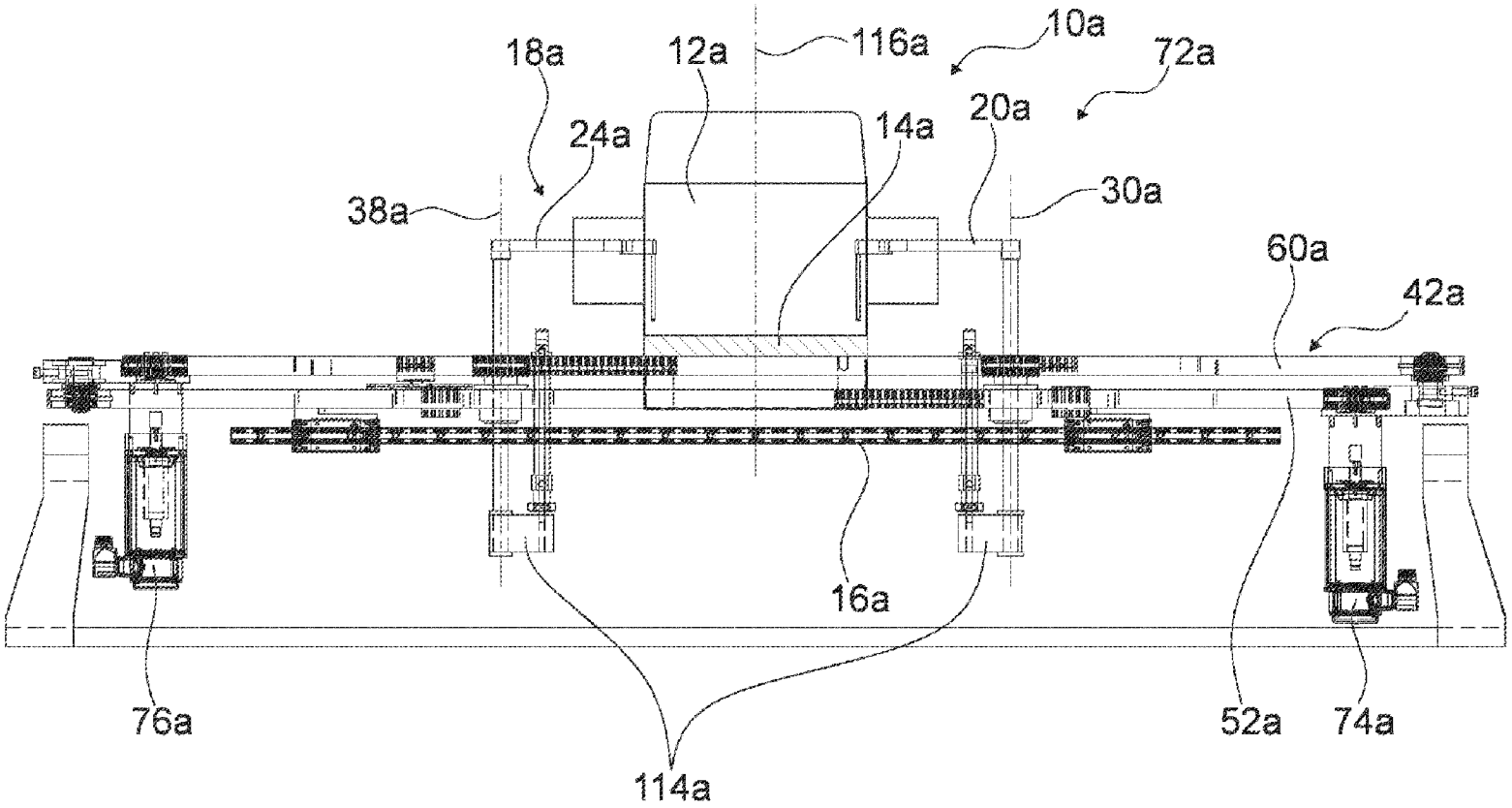
FIG. 2 shows a second view of the device according to the invention of the first exemplary embodiment.

The device 10*a* comprises a linear axis 16*a* and a pair of pivot arms 18*a* which includes a first pivot arm 20*a* and a second pivot arm 24*a* which, with reference to a symmetry axis 22*a* which is perpendicular to the linear axis 16*a*, is arranged in a mirror-symmetrical manner to the first pivot arm 20*a*. In FIG. 1 described here, the first pivot arm 20*a* is arranged on the right-hand side and the second pivot arm 24*a* is arranged on the left-hand side. This provides a convention in this description and is not to be understood as binding.

The first pivot arm 20*a* is mounted by way of a first pivot arm rotary bearing 26*a* so as to be rotatable in a first rotational movement 28*a* about a first pivot arm rotational axis 30*a* which is perpendicular to the symmetry axis 22*a* and so as to be displaceable in a first displacement movement 32*a* in the direction of the linear axis 16*a*.

The second pivot arm 24*a* is mounted by way of a second pivot arm rotary bearing 34*a* so as to be rotatable in a second rotational movement 36*a* about a second pivot arm rotational axis 38*a* which is perpendicular to the symmetry axis 22*a* and so as to be displaceable in a second displacement movement 40*a* in the direction of the linear axis 16*a*. The pivot arm rotational axes 30*a*, 38*a* are parallel to a symmetry plane 116*a* which is perpendicular to the linear axis 16*a*.

In each case on an end region located opposite the pivot arm rotary bearings 26*a*, 34*a*, the first and the second pivot arms 20*a*, 24*a* comprise active means which are realized as rod-shaped fingers 84*a*, 86*a* and are oriented in the direction of the pivot arm rotational axes 30*a*, 38*a*. The fingers 84*a*, 86*a* serve for the purpose of carrying out a desired processing operation on the packaging container 12*a* as a result of positive locking.

A coupler mechanism 42*a* is provided for the purpose of generating the first rotational movement 28*a* and the first displacement movement 32*a* of the first pivot arm 20*a* and the second rotational movement 36*a* and the second displacement movement 40*a* of the second pivot arm 24*a* from a first drive movement 44*a* and a second drive movement 46*a*. The first drive movement 44*a* is generated by a first drive unit 74*a*, the second drive movement 46*a* is generated by a second drive unit 76*a*. The drive units 74*a*, 76*a* are formed in each case by synchronous motors which are actuated by a control unit 78*a* such that the pair of pivot arms 18*a* carries out the movements necessary for processing the packaging container 12*a*.

The first rotational movement 28*a* and the second rotational movement 36*a* and the first displacement movement 32*a* and the second displacement movement 40*a* are in each case synchronous with one another in opposite directions. This is ensured by the kinematics of the coupler mechanism 42*a* described below.

The coupler mechanism 42*a* comprises a first mechanism element 52*a* which is provided for the purpose of generating from the first drive movement 44*a* a first advance movement 54*a* which is parallel to the linear axis 16*a* and a synchronous first return movement 56*a* which is parallel to the linear axis 16*a* and in the direction opposite to the first advance movement 54*a*. The mechanism element 52*a* is formed by a toothed belt which is guided in a circuit about a drive roller 80*a* and a tension roller 82*a*. The drive roller 80*a* is driven by the first drive unit 74*a* with the drive movement 44*a*. The drive roller 80*a* and the tension roller 82*a* are arranged on end regions of the linear axis 16*a* which are situated opposite one another in the direction of the displacement movements 32*a*, 40*a* such that the circuit of the mechanism element 52*a* extends parallel to the linear axis 16*a* in a region of the linear axis 16*a* in which the pivot arm rotary bearings 26*a*, 34*a* are moved in the displacement movements 32*a*, 40*a*. In the example shown, the mechanism element 52*a* carries out the first advance movement 54*a*, on its path between the drive roller 80*a* of the first drive unit 74*a* and the tension roller 82*a*, on an advance side 68*a* of the circuit remote from the fingers 84*a*, 86*a* of the pair of pivot arms 18*a* and carries out the first return movement 56*a* on a return side 70*a* of the circuit facing the pair of pivot arms 18*a*.

The coupler mechanism 42*a* comprises coupling means 58*a*, 59*a* which are provided for transmitting the first advance movement 54*a* to the first pivot arm 20*a* and the first return movement 56*a* to the second pivot arm 24*a*. A first coupling means 58*a* connects the mechanism element 52*a* in the region of the first advance movement 54*a* to a carriage 48*a*, on which the first pivot arm rotary bearing 26*a* with the first pivot arm 20*a* is mounted so as to be displaceable on the linear axis 16*a*. A second coupling means 59*a* connects the mechanism element 52*a* in the region of the first return movement 56*a* to a carriage 50*a*, on which the second pivot arm rotary bearing 34*a* with the second pivot arm 24*a* is mounted so as to be displaceable on the linear axis 16*a*. The first advance movement 54*a* is consequently transmitted as first displacement movement 32*a* onto the first pivot arm 20*a* and the first return movement 56*a* is consequently transmitted as second displacement movement 40*a* onto the second pivot arm 24*a*. The two displacement movements 32*a*, 40*a* are in each case synchronous with one another in opposite directions.

The coupler mechanism 42*a* further comprises a second mechanism element 60*a* which is provided for the purpose of generating from the second drive movement 46*a* a second advance movement 62*a* which is parallel to the linear axis 16*a* and a synchronous second return movement 64*a* which is parallel to the linear axis 16*a* and in the direction opposite to the second advance movement 62*a*. The mechanism element 60*a*, as the mechanism element 52*a*, is formed by a toothed belt which is guided in a circuit about a further drive roller 81*a* and a further tension roller 83*a*. The further drive roller 81*a* is driven by the second drive unit 76*a* with the drive movement 46*a*. The drive roller 81*a* and the tension roller 83*a* are arranged on end regions of the linear axis 16*a* which are situated opposite one another in the direction of the displacement movements 32*a*, 40*a* such that the circuit of the mechanism element 52*a* extends parallel to the linear axis 16*a* in a region of the linear axis 16*a* in which the pivot arm rotary bearings 26*a*, 34*a* are moved in the displacement movements 32*a*, 40*a*. In the example shown, the mechanism element 60*a* carries out the second advance movement 62*a*, on its path between the drive roller 81*a* of the second drive unit 76*a* and the tension roller 83*a*, on an advance side 68*a* of the circuit remote from the fingers 84*a*, 86*a* of the pair of pivot arms 18*a* and carries out the second return movement 64*a* on the return side 70*a* of the circuit facing the pair of pivot arms 18*a*.

The coupler mechanism 42*a* comprises rotary coupling means 66*a*, 67*a* which are provided for the purpose of generating the first rotational movement 28*a* from a relative movement of the second advance movement 62*a* with reference to the first pivot arm rotational axis 30*a* and generating the second rotational movement 36*a* from a relative movement of the second return movement 64*a* with reference to the second pivot arm rotational axis 38*a*.

A rotary drive wheel 88*a*, 90*a*, which is formed by a toothed wheel, is non-rotatably arranged in each case on the pivot arm rotary bearings 26*a*, 34*a*. Tension rollers 92*a*, 94*a* are arranged on the sides of the carriages 48*a*, 50*a* opposite the pivot arm rotary bearings 26*a*, 34*a*. Toothed belts 96*a*, 98*a* are arranged in each case in circuits about the respective pivot arm rotary bearings 26*a*, 34*a* and about the tension rollers 92*a*, 94*a* of the carriages 48*a*, 50*a*.

A rotary coupling means 66*a* connects the mechanism element 60*a* in the region of the second advance movement 62*a* to a region of the circuit of the toothed belt 96*a* which is parallel to the advance movement 62*a* and faces the advance side 68*a*. The toothed belt 96*a* is moved in said region on the advance side 68*a* consequently at a relative speed of the second advance movement 62*a* and of the first advance movement 54*a*, at which the carriage 48*a* is moved in the first displacement movement 32*a*. The toothed belt 96*a* forwards said relative movement to a circumference of the rotary drive wheel 88*a* such that it drives the first pivot arm 20*a* in the first rotational direction 28*a*.

A further rotary coupling means 67*a* connects the mechanism element 60*a* in the region of the second return movement 64*a* to a region of the circuit of the second toothed belt 98*a* which is parallel to the return movement 64*a* and faces the advance side 68*a*. The toothed belt 98*a* is moved in said region on the advance side 68*a* consequently at a relative speed of the second return movement 64*a* and of the first return movement 56*a*, at which the carriage 50*a* is moved in the second displacement movement 40*a*. The toothed belt 98*a* forwards said relative movement to a circumference of the rotary drive wheel 90*a* such that it drives the second pivot arm 24*a* in the second rotational direction 36*a*.

The rotary movements 28*a* and 36*a*, in this case, are in each case synchronous with one another in the opposite direction. This is achieved, in particular, by the rotary coupling means 66*a* transmitting the relative movement of the second advance movement 62*a* from the advance side 68*a* of the second mechanism element 60*a* to the side of the circuit of the first toothed belt 96*a* facing the advance side 68*a* and the coupling means 67*a* transmitting the relative movement of the second return movement 64*a* from the return side 70*a* of the second mechanism element 60*a* to the side of the circuit of the second toothed belt 98*a* facing the advance side 68*a*. The coupling means 67*a* is realized for this purpose such that it extends from the return side 70*a* of the second mechanism element 60*a* up to the side of the second toothed belt 98*a* facing the advance side 68*a*. The identical effect can be achieved when the coupling means 67*a* connects the return side 70*a* of the second mechanism element 60*a* to the side of the circuit of the toothed belt 98*a* facing the return side 70*a* and the rotary coupling means 66*a* connects the advance side 68*a* of the second mechanism element 60*a* to the side of the circuit of the toothed belt 96*a* facing the return side 70*a*.

In order, when processing the packaging container 12*a*, to be able to move the fingers 84*a*, 86*a* into engagement with the tension element 14*a* and to withdraw the fingers 84*a*, 86*a* again after the processing, the pivot arms 20*a*, 24*a* are mounted so as to be displaceable in a lifting movement 100*a* parallel to the pivot arm rotational axes 30*a*, 38*a*. The lifting movement 100*a* is driven by two lift drives 114*a* which comprise in each case a pneumatic cylinder. As an alternative to this, it is also possible for one common lift drive to be provided for the purpose of driving the lifting movement 100*a* of both pivot arms 20*a*, 24*a*. The person skilled in the art will provide a suitable connecting element in this case in order to transmit the lifting movement 100*a* to both pivot arms 20*a*, 24*a*. At the end of the processing, the pivot arms 20*a*, 24*a* are moved away from the packaging container 12*a* in the lifting movement 100*a* and back into a starting position.

FIG. 3 shows three positions I-III of the pair of pivot arms 18*a* during a method for processing the one packaging container 12*a* for tensioning the one tensioning element 14*a* of the packaging container 12*a*, with the device 10*a*, with the one pair of pivot arms 18*a* which includes the one first pivot arm 20*a* and the one second pivot arm 24*a* which is arranged in a mirror-symmetrical manner with respect to the first pivot arm 20*a* with reference to the symmetry axis 22*a* which is perpendicular to the linear axis 16*a*, in the method the first pivot arm 20*a* being rotated in the first rotational movement 28*a* about the first pivot arm rotational axis 30*a* which is perpendicular to the symmetry axis 22*a* and being displaced in the first displacement movement 32*a* in the direction of the linear axis 16*a* and the second pivot arm 24*a* being rotated in the second rotational movement 36*a* about the second pivot arm rotational axis 38*a* which is perpendicular to the symmetry axis 22*a* and being displaced in the second displacement movement 40*a* in the direction of the linear axis 16*a*, the coupler mechanism 42*a* generating the first rotational movement 28*a* and the first displacement movement 32*a* of the first pivot arm 20*a* and the second rotational movement 36*a* and the second displacement movement 40*a* of the second pivot arm 24*a* from the first drive movement 44*a* and the second drive movement 46*a*, and the first rotational movement 28*a* and the second rotational movement 36*a* as well as the first displacement movement 32*a* and the second displacement movement 40*a* being in each case synchronous with one another in opposite directions. In position I, the fingers 84*a*, 86*a* are placed on the tensioning element 14*a* on a side facing the linear axis 16*a*. The tensioning element 14*a* is tensioned in combined rotational movements 28*a*, 36*a* and displacement movements 32*a*, 40*a* from position I via position II to position III such that products are able to be inserted into the packaging container 12*a*. The fingers 84*a*, 86*a* are then withdrawn in the lifting movement 100*a* such that the tensioning element 14*a* only exerts a tension force on the inserted products in the direction of a removal opening of the packaging container 12*a*.

Four further exemplary embodiments of the invention are shown in FIGS. 5 to 8. The following description and the drawings are essentially limited to the differences between the exemplary embodiments, it being possible with reference to identically designated components, in particular with reference to components with identical reference symbols, also to refer to the drawings and/or the description of the other exemplary embodiments, in particular of FIGS. 1 to 4. To differentiate between the exemplary embodiments, the letter a is placed after the reference symbols of the exemplary embodiment in FIGS. 1 to 3. The letter a is replaced by the letters b to e in the exemplary embodiments of FIGS. 5 to 8.

Figure 5:
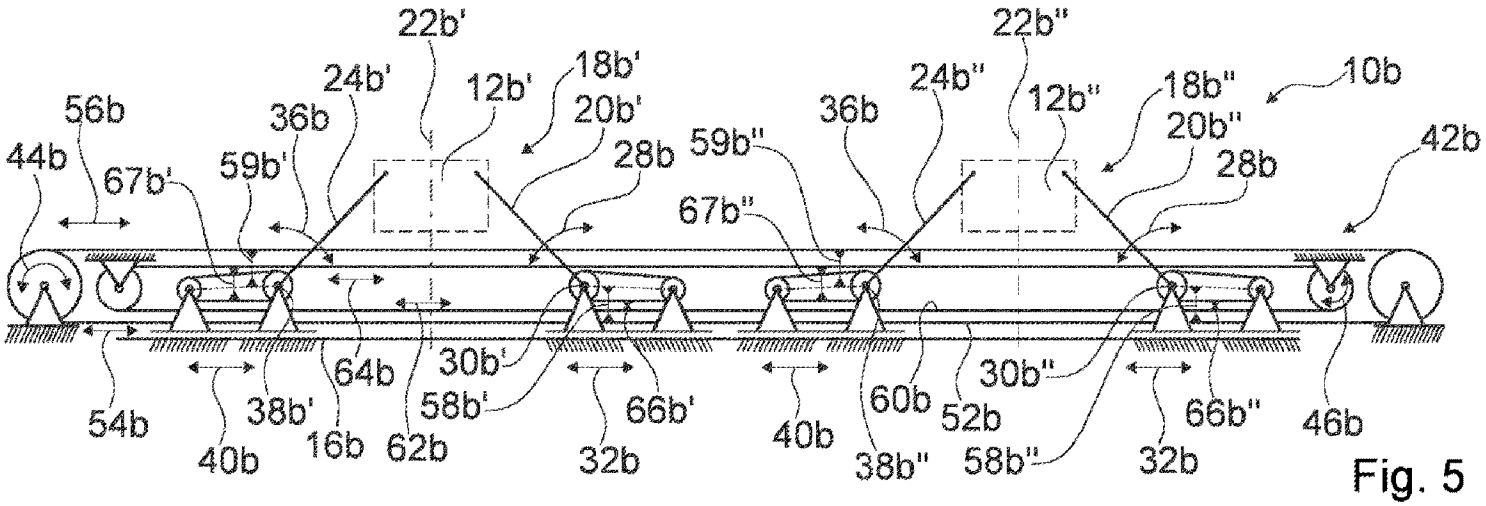
FIG. 5 shows a functional diagram of a device according to the invention in a second exemplary embodiment.

FIG. 5 shows a schematic diagram of a device 10*b* in a second exemplary embodiment. The device 10*b* differs from the device 10*a* of the first exemplary embodiment in particular by a plurality of pairs of pivot arms 18*b*', 18*b*", in the case shown the two pairs of pivot arms 18*b*', 18*b*", each with a first pivot arm 20*b*', 20*b*" and a second pivot arm 24*b*', 24*b*", each pair of pivot arms 18*b*', 18*b*" being arranged symmetrically to a symmetry axis 22*b*', 22*b*" and being provided for processing a packaging container 12*b*', 12*b*".

The pairs of pivot arms 18*b*', 18*b*", as shown in the previous example, are driven by a coupler mechanism 42*b* which includes two circulating mechanism elements 52*b*, 60*b* formed by toothed belts. The first pivot arms 20*b*', 20*b*", in this case, are driven synchronously with one another in a first rotational movement 28*b* and a first displacement movement 32*b* in the direction of a linear axis 16*b* and are driven synchronously in the opposite direction with the second pivot arms 24*b*', 24*b*" which are driven in a second rotational movement 36*b* and a second displacement movement 40*b*. The coupler mechanism 42*b* comprises coupling means 58*b*', 58*b*", 59*b*' and 59*b*" which are provided for the purpose of transmitting a first advance movement 54*b* to the two first pivot arms 20*b*', 20*b*" and a first return movement 56*b* to the second pivot arms 24*b*', 24*b*". The coupler mechanism 42*b* further comprises rotary coupling means 66*b*', 66*b*", 67*b*', 67*b*" which are provided for the purpose of generating the first rotational movement 28*b* from a relative movement of a second advance movement 62*b* with reference to first pivot arm rotational axes 30*b*', 30*b*" and generating the second rotational movement 36*b* from a relative movement of a second return movement 64*b* with reference to a second pivot arm rotational axis 38*b*', 38*b*".

Two packaging containers 12*b*', 12*b*" can be processed at the same time by the two pairs of pivot arms 18*b*', 18*b*" which are driven together by the coupler mechanism 42*b*. The device is driven in addition by a first and a second drive movement 44*b*, 46*b*.

Figure 6:
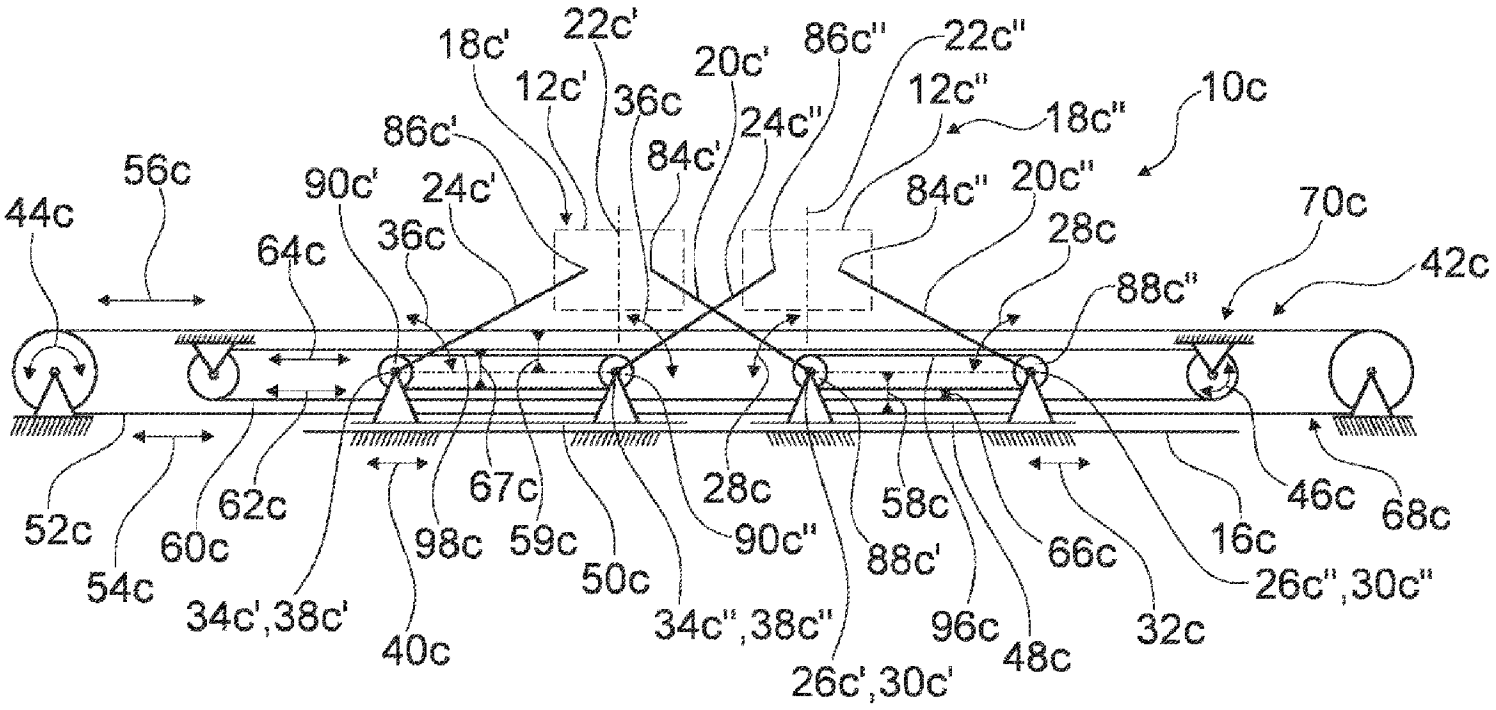
FIG. 6 shows a functional diagram of a device according to the invention in a third exemplary embodiment.

FIG. 6 shows a schematic diagram of a device 10*c* for processing two packaging containers 12*c*', 12*c*" in a third exemplary embodiment. The device 10*c* differs from the device 10*b* of the second exemplary embodiment in particular in that in an operating state a second pivot arm 24*c*" of a pair of pivot arms 18*c*" and a first pivot arm 20*c*' of a further pair of pivot arms 18*c*' adjacent in the direction of a linear axis 16*c* are arranged so as to cross over. The pivot arms 20*c*', 24*c*' and 20*c*" and 24*c*" are arranged in each case symmetrically to a symmetry axis 22*c*', 22*c*". The pivot arms 20*c*', 24*c*', 20*c*", 24*c*" are in each case mounted so as to be rotatable about a pivot arm rotational axis 30*c*', 30*c*", 38*c*', 38*c*". The pivot arms 20*c*', 24*c*', 20*c*", 24*c*" comprise in each case an active means which is realized as a finger 84*c*, 86*c*', 84*c*", 86*c*". This is achieved by a distance between the pairs of pivot arms 18*c*', 18*c*" in the direction of the linear axis 16*c* being reduced in relation to the second exemplary embodiment until the pivot arms 24*c*", 20*c*' cross, proceeding from their pivot arm rotational axes 38*c*", 30*c*' toward their fingers 84*c*', 86*c*", when viewed from a direction which is perpendicular to the linear axis 16*c* and to the symmetry axes 22*c*', 22*c*" of the pairs of pivot arms 18*c*', 18*c*". The pivot arms 24*c*", 20*c*', in this case, are arranged perpendicular to the drawing plane offset somewhat in their height in order to avoid a collision between the pivot arms 24*c*", 20*c*'. The first pivot arms 20*c*', 20*c*", as in the preceding example, are driven synchronously with one another in the direction of the linear axis 16*c* in a first rotational movement 28*c* and a first displacement movement 32*c* and are driven synchronously in opposite directions to the second pivot arms 24*c*', 24*c*" which are driven in a second rotational movement 36*c* and a second displacement movement 40*c*.

The device is consequently more compact, pivot arm rotary bearings 26*c*', 26*c*" and pivot arm rotary bearings 34*c*', 34*c*", in particular, are arranged adjacent in the direction of the linear axis 16*c*. This allows the two first pivot arms 20*c*', 20*c*" to be rotatably mounted on one common carriage 48*c* which is mounted so as to be displaceable on the linear axis 16*c* and the two second pivot arms 24*c*', 24*c*" to be rotatably mounted on a further common carriage 50*c* which is mounted so as to be displaceable on the linear axis 16*c*. The pivot arms 20*c*', 20*c*", 24*c*', 24*c*" comprise rotary drive wheels 88*c*' 88*c*", 90*c*', 90*c*" which are arranged in each case so as to be non-rotatable about their pivot arm rotary bearings 26*c*', 26*c*", 34*c*', 34*c*". A toothed belt 96*c* is arranged in a circuit about the rotary drive wheels 88*c*', 88*c*" and a toothed belt 98*c* is arranged in a circuit about the rotary drive wheels 90*c*', 90*c*". Tension rollers as in the preceding example can consequently be omitted and the pairs of pivot arms 20*c*', 20*c*" and 24*c*', 24*c*" can be driven via the toothed belts 96*c*, 98*c* in each case by common coupling means 58*c*, 59*c* and rotary coupling means 66*c*, 67*c*, which, as in the preceding examples, transmit advance and return movements 54*c*, 56*c*, 62*c*, 64*c* from an advance side 68*c* and a return side 70*c* from mechanism elements 52*c*, 60*c* of a coupler mechanism 42*c*. The mechanism elements 52*c*, 60*c* are driven with drive movements 44*c* 46*c*. There is a saving in components in comparison with the second exemplary embodiment.

Figure 7:
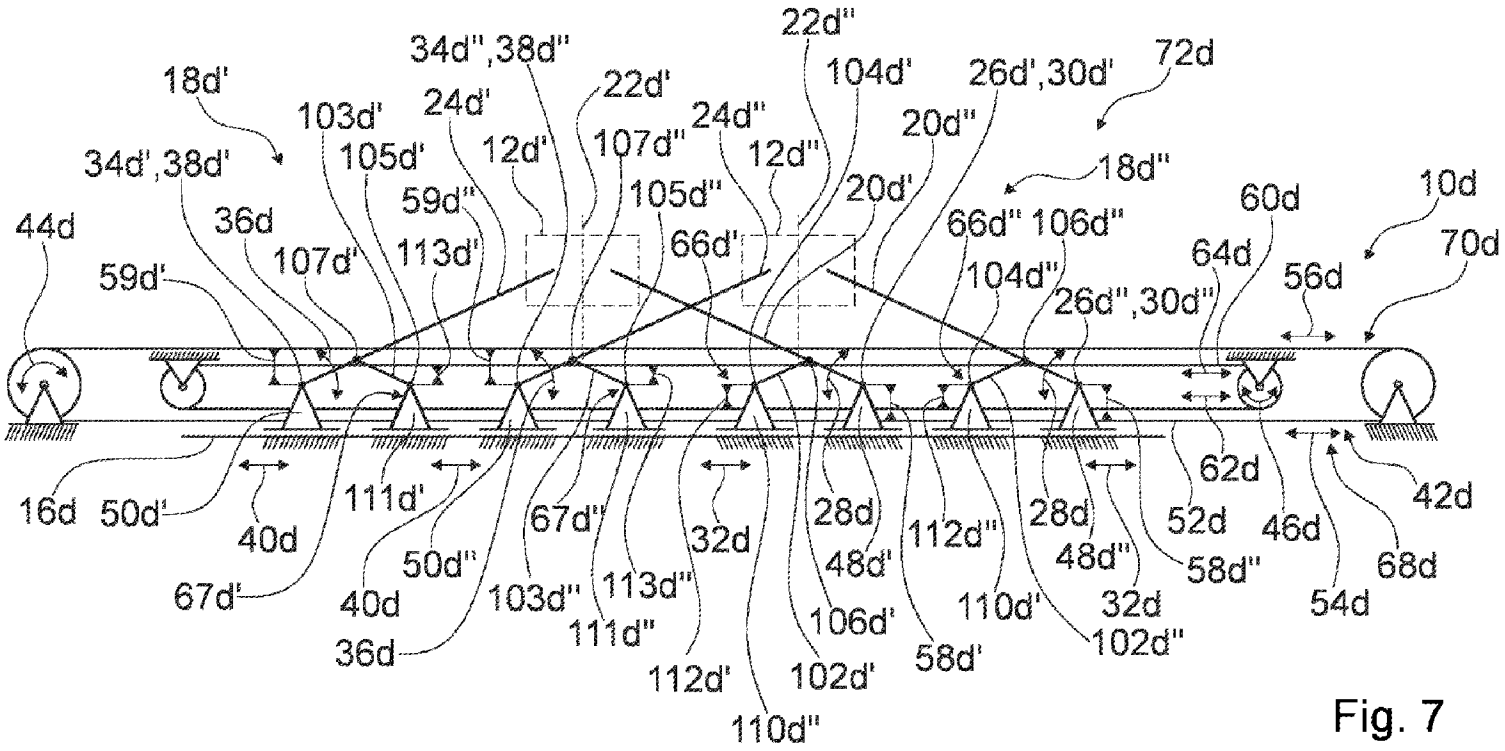
FIG. 7 shows a functional diagram of a device according to the invention in a fourth exemplary embodiment and FIG. 8 shows a functional diagram of a device according to the invention in a fifth exemplary embodiment.

FIG. 7 shows a schematic diagram of a device 10*d* with two pairs of pivot arms 18', 18*d*" for processing two packaging containers 12*d*', 12*d*" in a fourth exemplary embodiment. The device 10*d* differs from the device 10*c* of the third exemplary embodiment in particular in that rotary coupling means 66*d*', 66*d*", 67*d*', 67*d*" are formed by lever mechanisms. The device 10*d*, as the devices 10*a* to 10*c* of preceding exemplary embodiments, comprises a coupler mechanism 42*d* with a first mechanism element 52*d* and a second mechanism element 60*d*. The mechanism elements 52*d*, 60*d* are driven with drive movements 44*d*, 46*d*. The mechanism elements 52*d*, 60*d* generate in the known manner oppositely synchronous first advance and return movements 54*d*, 56*d* and second advance and return movements 62*d*, 64*d*. Two first coupling means 58*d*', 58*d*" connect the mechanism element 52*d* in the region of the first advance movement 54*d* to carriages 48*d*', 48*d*" on which in each case first pivot arm rotary bearings 26*d*', 26*d*" are mounted with a first pivot arm 20*d*', 20*d*" so as to be displaceable on a linear axis 16*d*. The pivot arms 20*d*', 24*d*' and 20*d*" and 24*d*" are in each case arranged symmetrically to a symmetry axis 22*d*', 22*d*". Two second coupling means 59*d*', 59*d*" connect the mechanism element 52*d* in the region of the first return movement 56*d* to carriages 50*d*', 50*d*" on which in each case second pivot arm rotary bearings 34*d*', 34*d*" are mounted with second pivot arms 24*d*', 24*d*" so as to be displaceable on the linear axis 16*d*. The first advance movement 54*d* is consequently transmitted as first displacement movement 32*d* to the first pivot arms 20*d*', 20*d*" and the first return movement 56*d* is consequently transmitted as second displacement movement 40*d* to the second pivot arms 24*d*', 24*d*". The rotary coupling means 66*d*', 66*d*" comprise in each case a carriage 110*d*', 110*d*" which is displaceably mounted on the linear axis 16*d* with in each case a rotary bearing 104*d*, 104*d*". The carriages 110*d*', 110*d*" are in each case connected in a positive locking manner via a connecting element 112*d*', 112*d*" to an advance side 68*d* of the second mechanism element 60*d* which is realized as a toothed belt such that the carriages 110*d*', 110*d*" are driven with the rotary bearings 104*d*', 104*d*" with the second advance movement 62*d*. The coupling means 67*d* comprise in each case a carriage 111*d*', 111*d*", which is mounted so as to be displaceable on the linear axis 16*d*, with in each case a rotary bearing 105*d*', 105*d*". The carriages 111*d*', 111*d*" are connected in a positive locking manner in each case via a connecting element 113*d*', 113*d*" to a return side 70*d* of the second mechanism element 60*d* which is realized as a toothed belt, such that the carriages 111*d*', 111*d*" are driven with the rotary bearings 105*d*', 105*d*" with the second return movement 64*d*.

The first pivot arms 20*d*', 20*d*" and the second pivot arms 24*d*' 24*d*" of the two pairs of pivot arms 18*d*', 18*d*" comprise pivotally mounted bearings 106*d*', 106*d*", 107*d*', 107*d*" in each case at identical distances from their pivot arm rotational axes 30*d*', 30*d*", 38*d*' 38*d*". The distances between the pivotally mounted bearings 106*d*', 106*d*", 107*d*', 107*d*" and the respective pivot arm rotational axes 30*d*', 30*d*", 38*d*' 38*d*" will be established in a suitable manner by the person skilled in the art. A lever 102*d*', 102*d*" is flexibly mounted in each case between the pivotally mounted bearings 106*d*', 106*d*" of the first pivot arms 20*d*', 20*d*" and the rotary bearings 104*d*', 104*d*" of the carriages 110*d*', 110*d*". A lever 103*d*', 103*d*" is flexibly mounted in each case between the pivotally mounted bearings 107*d*', 107*d*" of the second pivot arms 24*d*', 24*d*" and the rotary bearings 105*d*', 105*d*" of the carriages 111*d*', 111*d*". Relative speeds of the second advance and return movements 62*d*, 64*d* with reference to the first advance and return movements 54*d*, 56*d* bring about in each case relative speeds of the rotary bearings 104*d*', 104*d*", 105*d*', 105*d*" with the pivot arm rotational axes 30*d*', 30*d*", 38*d*', 38*d*". On account of the coupling of the pivot arms 20*d*', 20*d*", 24*d*', 24*d*" with the rotary bearings 104*d*', 104*d*", 105*d*', 105*d*" via the levers 102*d*', 102*d*", 130*d*', 103*d*", the first pivot arms 20*d*', 20*d*" are driven in a first rotational movement 28*d* and the second pivot arms 24*d*', 24*d*" are driven in a second rotational movement 36*d*.

Figure 8:
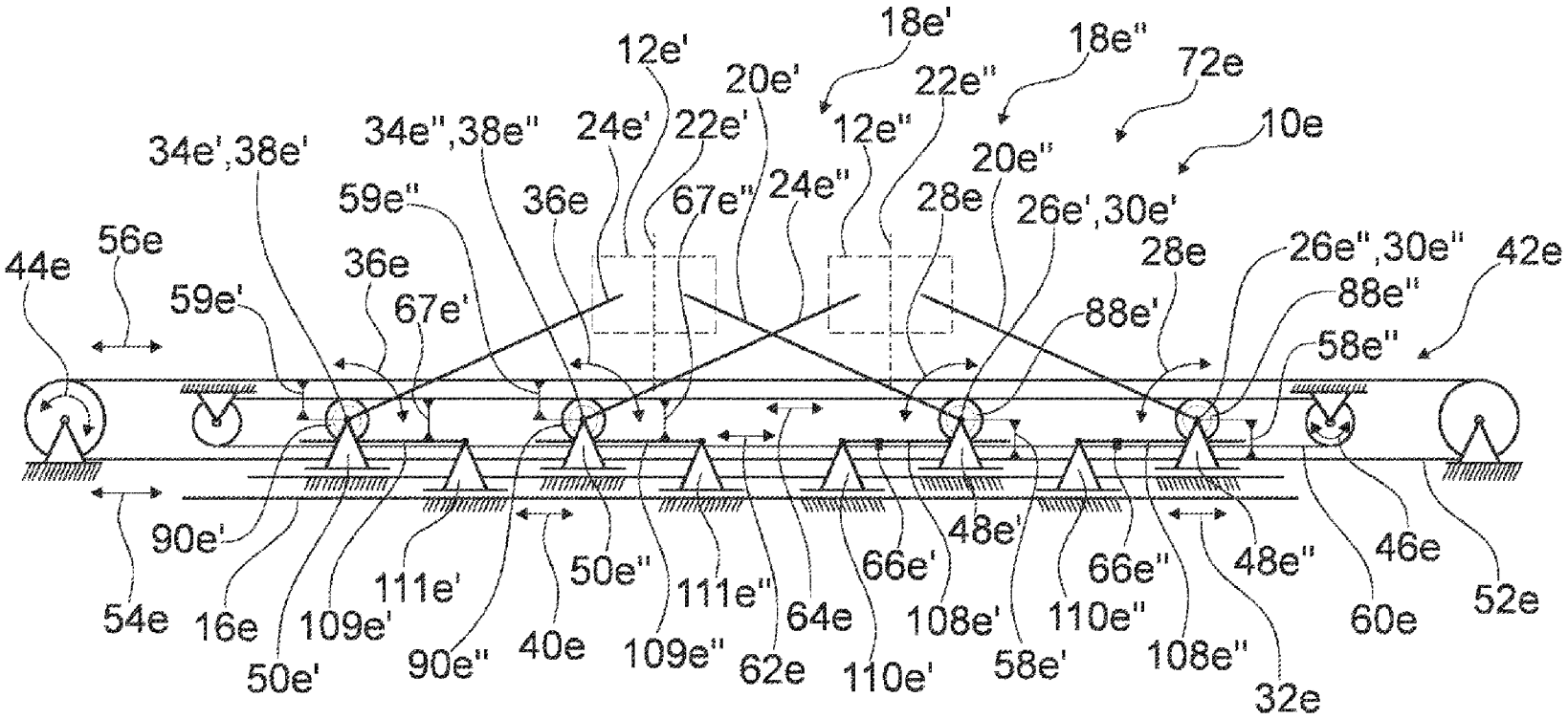

FIG. 8 shows a schematic diagram of a device 10*e* for processing two packaging containers 12*e*', 12*e*" in a fifth exemplary embodiment. The device 10*e* is provided for use in a packaging container 72*e*. The device 10*e* differs from the device 10*c* of the third exemplary embodiment in particular in that toothed rods 108*e*', 108*e*", 109*e*', 109*e*" are provided for the purpose of driving pivot arms 20*e*', 20*e*", 24*e*', 24*e*" of second pairs of pivot arms 18*e*', 18*e*" in a first and a second rotational movement 28*e*, 36*e* about pivot arm rotational axes 30*e*', 30*e*", 38*e*', 38*e*". The pivot arms 20*e*', 24*e*' and 20*e*" and 24*e*" are in each case arranged symmetrically to a symmetry axis 22*e*', 22*e*". The device 10*e*, as the devices 10*a* to 10*d* of the preceding exemplary embodiments, comprise a coupler mechanism 42*e* with a first mechanism element 52*e* and a second mechanism element 60*e*. The mechanism elements 52*e*, 60*e* are driven with drive movements 44*e*, 46*e*. The mechanism elements 52*e*, 60*e* generate in the known manner first advance and return movements 54*e*, 56*e* and second advance and return movements 62*e*, 64*e* which are synchronous in opposite directions. Two first coupling means 58*e*', 58*e*" connect the mechanism element 52*e* in the region of the first advance movement 54*e* to carriages 48*e*', 48*e*", on which in each case first pivot arm rotary bearings 26*e*', 26*e*" are mounted so as to be displaceable with the first pivot arm 20*e*', 20*e*" on a linear axis 16*e*. Two second coupling means 59*e*', 59*e*" connect the mechanism element 52*e* in the region of the first return movement 56*e* to carriages 50*e*', 50*e*", on which in each case second pivot arm rotary bearings 34*e*', 34*e*" are mounted so as to be displaceable with the second pivot arms 24*e*', 24*e*" on the linear axis 16*e*. The first advance movement 54*e* is consequently transmitted as first displacement movement 32*e* onto the first pivot arms 20*e*', 20*e*" and the first return movement 56*e* is consequently transmitted as second displacement movement 40*e* onto the second pivot arms 24*e*', 24*e*". The toothed rods 108*e*', 108*e*", 109*e*', 109*e*" are mounted in each case on an end region in each case on carriages 110*e*', 110*e*", 111*e*', 111*e*" which are mounted on the linear axis 16*e*. The carriages 110*e*', 110*e*" 111*e*', 111*e*" are connected to rotary coupling means 66*e*', 66*e*", 67*e*', 67*e*". The rotary coupling means 66*e*', 66*e*" are provided for the purpose of transmitting the second advance movement 62*e* to the carriages 110*e*', 110*e*" and the rotary coupling means 67*e*', 67*e*" are provided for the purpose of transmitting the second return movement 64*e* to the carriages 111*e*', 111*e*".

The pivot arms 20*e*', 20*e*" comprise in each case a rotary drive wheel 88*e*', 88*e*" which is realized as a toothed wheel and is arranged about its pivot arm rotary bearing 26*e*', 26*e*", in which rotary drive wheel a toothed rod 108*e*', 108*e*" which is moved with the second advance movement 62*e* engages in each case. The pivot arms 24*e*', 24*e*" comprise in each case a rotary drive wheel 90*e*', 90*e*" which is realized as a toothed wheel and is arranged about its pivot arm rotary bearing 34*e*', 34*e*", in which rotary drive wheel a toothed rod 109*e*', 109*e*" which is moved with the second return movement 64*e* engages in each case.

Relative speeds between the first and second advance movement 54*e*, 62*e* as well as the first and second return movement 56*e*, 64*e* consequently bring about the first rotational movement 28*e* and the second rotational movement 36*e* of the pivot arms 20*e*', 20*e*", 24*e*', 24*e*". The design is particularly compact as it is possible to dispense with tension rollers and a circuit of toothed belts as in the first three exemplary embodiments.

The invention claimed is:

1. A device for processing at least one packaging container (12*a-e*), the device comprising at least one linear axis (16*a-e*), comprising at least one pair of pivot arms (18*a-e*) including a first pivot arm (20*a-e*) and a second pivot arm (24*a-e*) arranged in a mirror-symmetrical manner with respect to the first pivot arm (20*a-e*) with reference to a symmetry axis (22*a-e*) perpendicular to the at least one linear axis (16*a-e*), wherein the first pivot arm (20*a-e*) is mounted so as to be rotatable in a first rotational movement (28*a-e*) about a first pivot arm rotational axis (30*a-e*) perpendicular to the symmetry axis (22*a-e*) and displaceable in a first displacement movement (32*a-e*) in the direction of the at least one linear axis (16*a-e*), and wherein the second pivot arm (24*a-e*) is mounted so as to be rotatable in a second rotational movement (36*a-e*) about a second pivot arm rotational axis (38*a-e*) perpendicular to the symmetry axis (22*a-e*) and displaceable in a second displacement movement (40*a-e*) in the direction of the at least one linear axis (16*a-e*), and comprising a coupler mechanism (42*a-e*) for generating the first rotational movement (28*a-e*) and the first displacement movement (32*a-e*) of the first pivot arm (20*a-e*) and the second rotational movement (36*a-e*) and the second displacement movement (40*a-e*) of the second pivot arm (24*a-e*) from at least one first drive movement (44*a-e*) and one second drive movement (46*a-e*), and wherein the first rotational movement (28*a-e*) and the second rotational movement (36*a-e*) as well as the first displacement movement (32*a-e*) and the second displacement movement (40*a-e*) are in each case synchronous with one another in opposite directions.

2. The device as claimed in claim 1, characterized by a plurality of pairs of pivot arms (18*b-e*) having in each case a first pivot arm (20*b-e*) and a second pivot arm (24*b-e*).

3. The device as claimed in claim 2, characterized in that in at least one operating state at least one second pivot arm (24*c-e*) of a pair of pivot arms (18*c-e*) and one first pivot arm (20*c-e*) of a further pair of pivot arms (18*c-e*) adjacent in the direction of the linear axis (16*c-e*) are arranged so as to cross over.

4. The device as claimed in at least claim 2, characterized in that at least two first pivot arms (20*c*', 20*c*") and/or at least two second pivot arms (24*c*', 24*c*") are rotatably mounted on in each case one common carriage (48*c*, 50*c*) which is mounted so as to be displaceable on the linear axis (16*c*).

5. The device as claimed in claim 1, characterized in that the coupler mechanism (42*a-e*) comprises at least one first mechanism element (52*a-e*) for generating from the first drive movement (44*a-e*) a first advance movement (54*a-e*) parallel to the linear axis (16*a-e*) and a synchronous first return movement (56*a-e*) parallel to the linear axis (16*a-e*) and is in the reverse direction to the first advance movement (54*a-e*).

6. The device as claimed in claim 5, characterized in that the coupler mechanism (42*a-e*) comprises coupling means (58*a-e*, 59*a-e*) for transmitting the first advance movement (54*a-e*) to the at least one first pivot arm (20*a-e*) and the first return movement (56*a-e*) to the at least one second pivot arm (24*a-e*).

7. The device as claimed in claim 1, characterized in that the coupler mechanism (42*a-e*) comprises at least one second mechanism element (60*a-e*) for generating from the second drive movement (46*a-e*) a second advance movement (62*a-e*) parallel to the linear axis (16*a-e*) and a synchronous second return movement (64*a-e*) parallel to the linear axis (16*a-e*) and is in the opposite direction to the second advance movement (64*a-e*).

8. The device as claimed in claim 7, characterized in that the coupler mechanism (42*a-e*) comprises rotary coupling means (66*a-e*, 67*c-e*) for generating the at least one first rotational movement (28*a-e*) from a relative movement of the second advance movement (62*a-e*) with reference to the at least one first pivot arm rotational axis (30*a-e*) and the at least one second rotational movement (36*a-e*) from a relative movement of the second return movement (64*a-e*) with reference to the at least one second pivot arm rotational axis (38*a-e*).

9. A packaging machine (72*a-e*) having a device (10*a-e*) as claimed in claim 1.

10. A method for processing at least one packaging container (12*a-e*), the method comprising providing a device (10*a-e*) with at least one pair of pivot arms (18*a-e*) including at least one first pivot arm (20*a-e*) and a second pivot arm (24*a-e*) arranged in a mirror-symmetrical manner to the first pivot arm (20*a-e*) with reference to a symmetry axis (22*a-e*) perpendicular to a linear axis (16*a-e*), rotating the first pivot arm (20*a-e*) in a first rotational movement (28*a-e*) about a first pivot arm rotational axis (30*a-e*) perpendicular to the symmetry axis (22*a-e*), displacing the first pivot arm in a first displacement movement (32*a-e*) in the direction of the linear axis (16*a-e*), rotating the second pivot arm (24*a-e*) in a second rotational movement (36*a-e*) about a second pivot arm rotational axis (38*a-e*) perpendicular to the symmetry axis (22*a-e*) and displacing the second pivot arm in a second displacement movement (40*a-e*) in the direction of the linear axis (16*a-e*), wherein a coupler mechanism (42*a-e*) generates the first rotational movement (28*a-e*) and the first displacement movement (32*a-e*) of the first pivot arm (22*a-e*) as well as the second rotational movement (36*a-e*) and the second displacement movement (40*a-e*) of the second pivot arm (24*a-e*) from at least one first drive movement (44*a-e*) and one second drive movement (46*a-e*), and wherein the first rotational movement (28*a-e*) and the second rotational movement (36*a-e*) as well as the first displacement movement (32*a-e*) and the second displacement movement (40*a-e*) are in each case synchronous with one another in opposite directions.

11. The device as claimed in claim 1, characterized by a plurality of pairs of pivot arms (18*b-e*) having in each case a first pivot arm (20*b-e*) and a second pivot arm (24*b-e*), wherein in each case one pair of pivot arms (18*b-e*) is provided for processing the packaging container (12*b-e*).

* * * * *